US007988142B2

(12) United States Patent
Sugiyama

(10) Patent No.: US 7,988,142 B2
(45) Date of Patent: Aug. 2, 2011

(54) SHEET FEEDER, SHUTTER OPENING AND CLOSING METHOD, AND IMAGE FORMING APPARATUS

(75) Inventor: Tadashi Sugiyama, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 69 days.

(21) Appl. No.: 12/371,291

(22) Filed: Feb. 13, 2009

(65) Prior Publication Data

US 2009/0200728 A1 Aug. 13, 2009

Related U.S. Application Data

(60) Provisional application No. 61/028,440, filed on Feb. 13, 2008.

(51) Int. Cl.
*B65H 3/44* (2006.01)
*B65H 1/26* (2006.01)

(52) U.S. Cl. ..... 271/9.01; 271/157; 271/158; 414/795.8

(58) Field of Classification Search ..... 271/9.01, 271/9.03, 9.05, 9.08, 9.12, 157; 414/795.8
See application file for complete search history.

(56) References Cited

U.S. PATENT DOCUMENTS

| | | | | |
|---|---|---|---|---|
| 5,085,421 | A * | 2/1992 | Sellers | 271/155 |
| 5,195,734 | A * | 3/1993 | Tanabe | 271/9.03 |
| 5,971,387 | A * | 10/1999 | Kita | 271/9.03 |
| 7,866,654 | B2 * | 1/2011 | Ohno | 271/9.08 |
| 2003/0141651 | A1 * | 7/2003 | Berdelle-Hilge et al. | 271/157 |
| 2009/0066007 | A1 * | 3/2009 | Sugiyama | 271/9.01 |
| 2009/0072467 | A1 * | 3/2009 | Ohno | 271/9.01 |

FOREIGN PATENT DOCUMENTS

| | | |
|---|---|---|
| JP | PH06-043710 | 2/1994 |
| JP | PH09-040196 | 2/1997 |

* cited by examiner

*Primary Examiner* — David H Bollinger
(74) *Attorney, Agent, or Firm* — Patterson & Sheridan, LLP

(57) ABSTRACT

An image forming apparatus according to the present invention includes: a first sheet feeding unit; a second sheet feeding unit provided adjacent to the first sheet feeding unit; one or plural first shutter(s) provided in the first sheet feeding unit; a driving unit that drives the first shutter(s); and one or plural second shutter(s) provided in the second sheet feeding unit, the second shutter(s) opening and closing in association with the opening and closing of the first shutter(s) driven by the driving unit. According to the present invention, when plural shutters for designating a stacking range of sheets are provided, an operation of any one of the shutters can be suitably associated with operations of the other shutters.

13 Claims, 9 Drawing Sheets

SHEET FEEDER, SHUTTER OPENING AND CLOSING METHOD, AND IMAGE FORMING APPARATUS

CROSS-REFERENCE TO RELATED APPLICATION

This application is based upon and claims the benefit of priority from U.S. provisional application 61/028,440, filed on Feb. 13, 2008, the entire contents of which is incorporated herein by reference.

TECHNICAL FIELD

The present invention relates to a sheet feeder and a shutter opening and closing method therefor and an image processing apparatus, and, more particularly to a sheet feeder in which a shutter can be opened and closed and a shutter opening and closing method therefor and an image forming apparatus.

BACKGROUND

Recently, besides a monochrome machine including a scanning optical system employing a single light source, a tandem color machine is also proposed. In the tandem color machine, for the purpose of realizing an increase of speed of scanning on the surfaces of photoconductive drums, plural light sources are provided in one laser unit. A method of increasing the number of laser beams for performing scanning once (a multi-beam method) is used.

In the tandem color machine, a large-capacity cassette feeder (LCF) that can store a large volume of sheets is provided. The large-capacity cassette feeder feeds sheets to a sheet conveying path as required.

If sheets are stacked in left and right independent cassettes in the large-capacity cassette feeder, in order to designate a stacking range of the sheets or in order to prevent the stacked sheets from extending beyond a predetermined stacking range, shutters are provided for each of the cassettes. However, power is required for the opening and closing of the shutters. Therefore, in the past, the number of electronic components such as solenoids used for the opening and closing of the shutters increases. It is possible to reduce the number of shutters in order to hold down the increase in the electronic components. However, if the number of shutters is reduced, the sheets extend beyond the stacking range.

SUMMARY

The present invention is devised in view of such a situation and it is an object of the present invention to provide a sheet feeder in which, if plural shutters for designating a stacking range of sheets are provided, an operation of any one of the shutters can be suitably associated with operations of the other shutters and a shutter opening and closing method therefor and an image forming apparatus.

In order to solve the problems, according to an aspect of the present invention, there is provided a sheet feeder including: a first sheet feeding unit; a second sheet feeding unit provided adjacent to the first sheet feeding unit; one or plural first shutters provided in the first sheet feeding unit; a driving unit configured to drive the first shutter; and one or plural second shutters provided in the second sheet feeding unit, the second shutter opening and closing in association with the opening and closing of the first shutter driven by the driving unit.

In order to solve the problems, according to another aspect of the present invention, there is provided a shutter opening and closing method for a sheet feeder including a first sheet feeding unit, a second sheet feeding unit provided adjacent to the first sheet feeding unit, one or plural first shutters provided in the first sheet feeding unit, a driving unit that drives the first shutter, and one or plural second shutters provided in the second sheet feeding unit, wherein the second shutter opens and closes in association with the opening and closing of the first shutter driven by the driving unit.

In order to solve the problems, according to still another aspect of the present invention, there is provided an image forming apparatus including: a first sheet feeding unit; a second sheet feeding unit provided adjacent to the first sheet feeding unit; one or plural first shutters provided in the first sheet feeding unit; a driving unit configured to drive the first shutter; and one or plural second shutters provided in the second sheet feeding unit, the second shutter opening and closing in association with the opening and closing of the first shutter driven by the driving unit.

DETAILED DESCRIPTION

An embodiment of the present invention is explained below with reference to the accompanying drawings.

Figure 1:
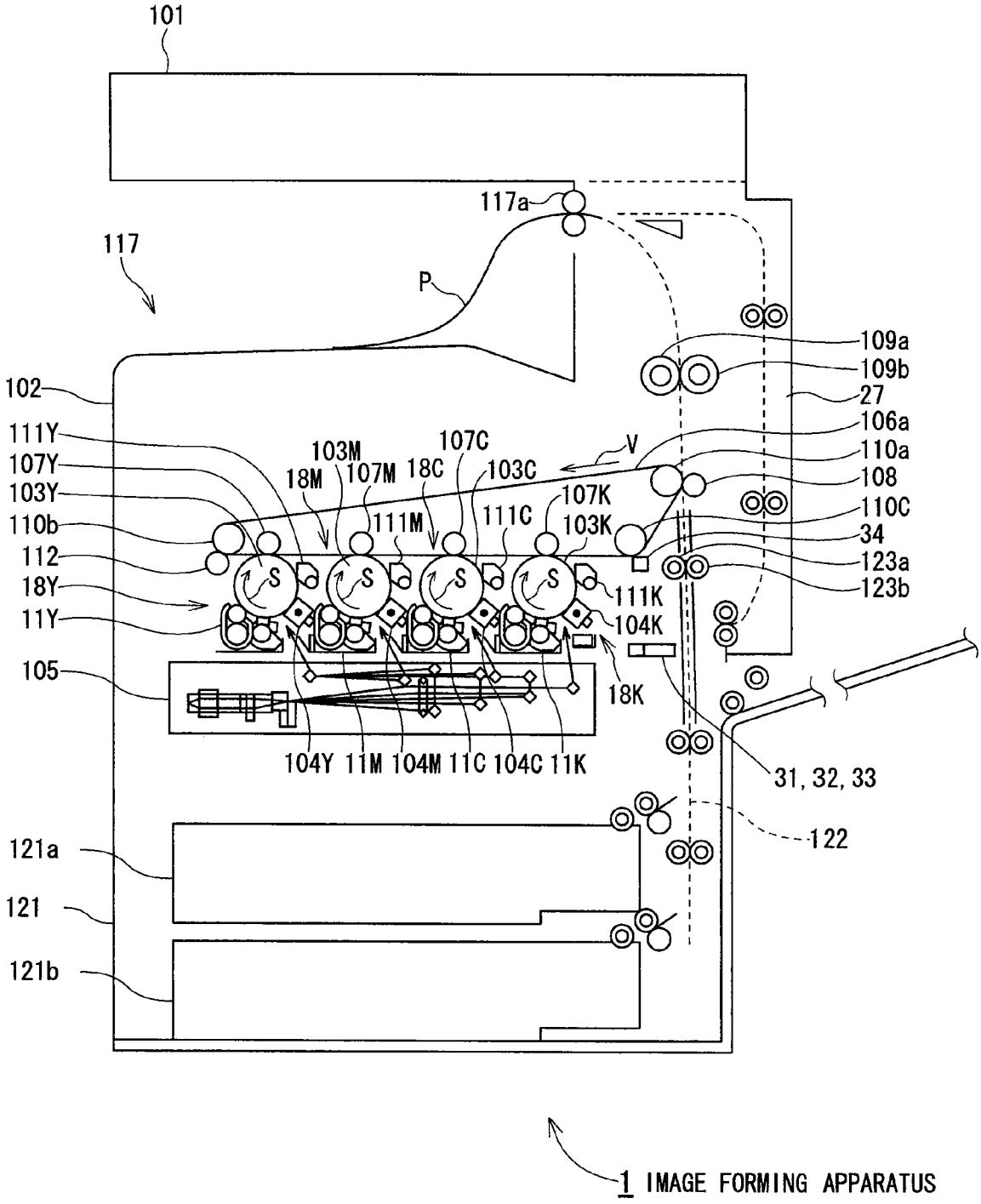
FIG. 1 is a diagram of a configuration of an image forming apparatus according to an embodiment of the present invention.

FIG. 1 is a diagram of a configuration of an image forming apparatus 1 according to this embodiment. As shown in FIG. 1, the image forming apparatus 1 includes a scanner unit 101 as image scanning means and a printer driving unit 102 as image forming means. The scanner unit 101 scans an original document placed on a document table glass. The image forming apparatus 1 includes a sheet feeding unit (a sheet feeder) 121 that feeds a sheet P in the direction of the printer driving unit 102. The sheet feeding unit 121 takes out the sheet P from a first sheet feeding unit 121*a* or a second sheet feeding unit 121*b* and feeds the sheet P in the direction of registration rollers 123 along a conveying path 122. The registration rollers 123 are conveying rollers for conveying the sheet P and include a fixed roller 123*a* and a movable roller 123*b*.

The printer driving unit 102 has four sets of image forming units 18 employing a quadruple-tandem electrophotographic process by reversal development. The image forming units 18 includes four sets of image forming units for yellow (Y), magenta (M), cyan (C), and black (K) and are arranged in parallel along a lower side of an intermediate transfer belt 106*a*. The image forming units 18Y, 18M, 18C, and 18K have the same configuration. Around photoconductive drums 103Y, 103M, 103C, and 103K of the image forming units 18Y, 18M, 18C, and 18K, charging units 104Y, 104M, 104C, and 104K, developing units 11Y, 11M, 11C, and 11K, photoconductive cleaners 111Y, 111M, 111C, and 111K, and charge eliminators 113Y, 113M, 113C, and 113K are respectively arranged along a rotating direction indicated by an arrow S.

A laser optical unit 105 irradiates laser beams to spaces between the charging units 104Y, 104M, 104C, and 104K and the developing units 11Y, 11M, 11C, and 11K arranged around the photoconductive drums 103Y, 103M, 103C, and 103K, respectively. The respective image forming units 18Y, 18M, 18C, and 18K form toner images on the photoconductive drums 103Y, 103M, 103C, and 103K.

Drum thermistors 30Y, 30M, 30C, and 30K are set in contact with non-image forming areas of the photoconductive drums 103Y, 103M, 103C, and 103K and detect surface temperatures of the photoconductive drums 103Y, 103M, 103C, and 103K. The photoconductive drums 103Y, 103M, 103C, and 103K are supported by unit frames integrally with the charging units 104Y, 104M, 104C, and 104K and can form process units.

Predetermined tension is applied to the intermediate transfer belt 106*a* by a driving roller 110*a*, a driven roller 110*b*, and a tension roller 110*c*. A belt cleaner 112 is arranged near the driven roller 110*b*. Primary transfer rollers 107Y, 107M, 107C, and 107K are arranged, via the intermediate transfer belt 106*a*, in primary transfer positions opposed to the photoconductive drums 103Y, 103M, 103C, and 103K. A secondary transfer roller 108 is arranged, via the intermediate transfer belt 106*a*, in a secondary transfer position opposed to the driving roller 110*a*. The sheet P is fed to the secondary transfer position from the first sheet feeding unit 121*a* or the second sheet feeding unit 121*b* through the conveying path 122. The secondary transfer roller 108 secondarily transfers a color toner image formed of toner images of plural colors superimposed on the intermediate transfer belt 106*a* onto the sheet P. A density sensor 34 is provided near the intermediate transfer belt 106*a* before reaching the driving roller 110*a*. The density sensor 34 detects the density of a toner image formed on the intermediate transfer belt 106*a*.

The printer driving unit 102 includes a fixing device 109 that fixes the color toner image on the sheet P transferred by the secondary transfer roller 108 on the sheet P and sheet discharge rollers 117*a* that discharge the sheet P after the fixing to a sheet discharge unit 117. The fixing device 109 includes a pressing roller 109*a* and a heating roller 109*b*. The printer driving unit 102 includes a reversal conveying mechanism 27 that reverses the sheet P during duplex image formation. The printer driving unit 102 also includes a temperature sensor 31, an atmospheric pressure sensor 32, and a relative humidity sensor 33.

The image forming apparatus 1 scans an original document with the scanner unit 101 during the start of an operation of an image forming process. The printer driving unit 102 drives the image forming units 18Y, 18M, 18C, and 18K and rotates the intermediate transfer belt 106*a* in an arrow V direction. The photoconductive drums 103Y, 103M, 103C, and 103K rotate in an arrow S direction and are charged by the charging units 104Y, 104M, 104C, and 104K. The laser optical unit 105 forms electrostatic latent images corresponding to an original document image on the photoconductive drums 103Y, 103M, 103C, and 103K. The developing units 11Y, 11M, 11C, and 11K form toner images on the photoconductive drums 103Y, 103M, 103C, and 103K.

The toner images on the photoconductive drums 103Y, 103M, 103C, and 103K are sequentially superimposed on the intermediate transfer belt 106*a* by the primary transfer rollers 107Y, 107M, 107C, and 107K. A color toner image is formed on the intermediate transfer belt 106*a*. The color toner image formed on the intermediate transfer belt 106*a* is secondarily transferred onto the sheet P collectively in the secondary transfer position by the secondary transfer roller 108. The sheet P is conveyed from the sheet feeding unit 121 to be timed to coincide with the color toner image on the intermediate transfer belt 106*a* reaching the secondary transfer position. The fixing device 109 fixes the color toner image on the sheet P.

The belt cleaner 112 cleans residual toners after the toner images are secondarily transferred onto the sheet P. The photoconductive cleaners 111Y, 111M, 111C, and 111K remove residual toners on the photoconductive drums 103Y, 103M, 103C, and 103K. The charge eliminators 113Y, 113M, 113C, and 113K remove residual charges of the photoconductive drums 103Y, 103M, 103C, and 103K.

Figure 2:
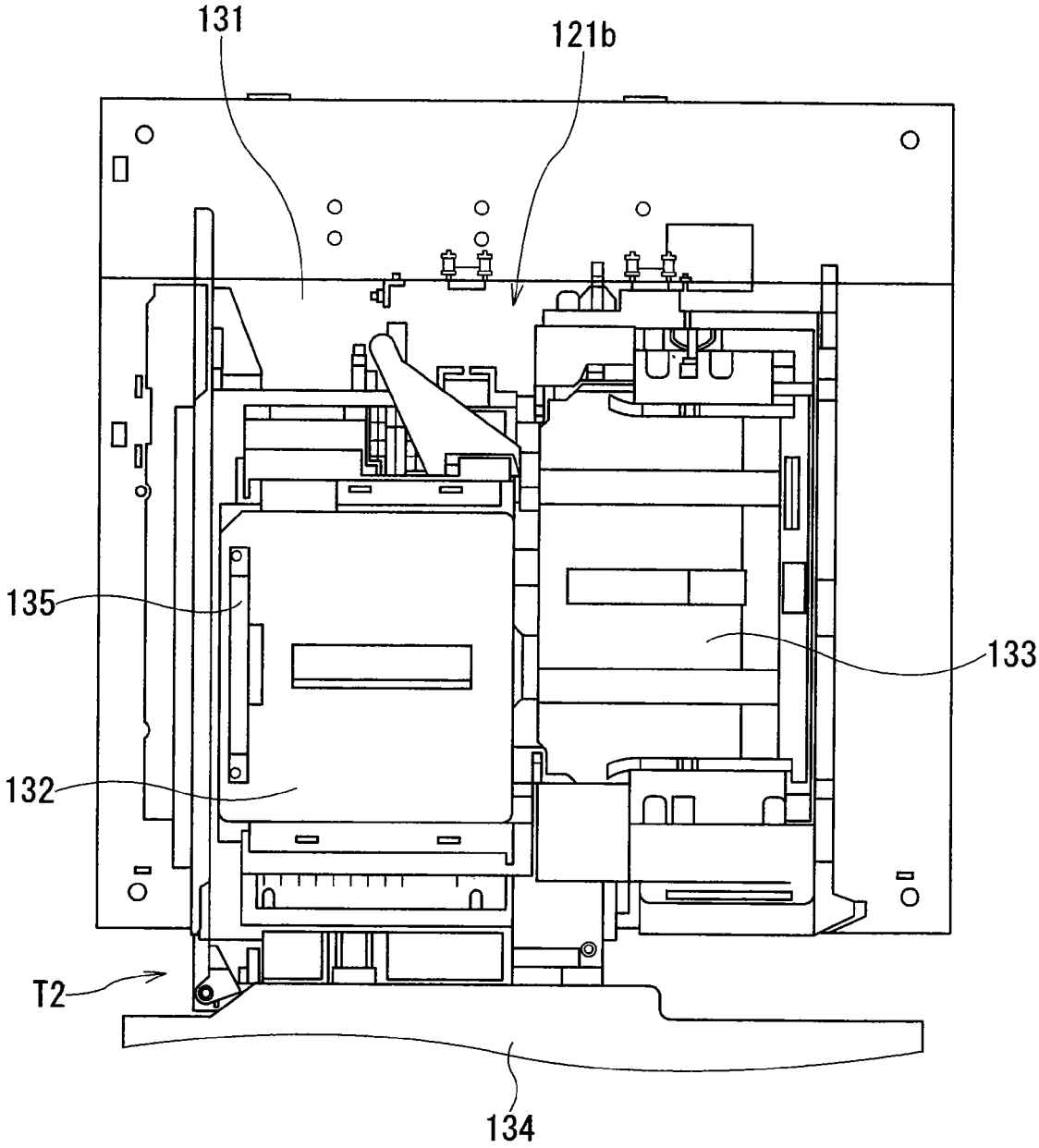
FIG. 2 is a sectional view in the horizontal direction of the image forming apparatus shown in FIG. 1.

FIG. 2 is a sectional view in the horizontal direction of the image forming apparatus 1 shown in FIG. 1. As shown in FIG. 2, the second sheet feeding unit 121*b* includes a sheet feeding cassette 132 (a first cassette) that can be inserted in an attaching unit 131, a standby cassette 133 (a second cassette) provided adjacent to the attaching unit 131, a lid member 134 that covers the outer side of the sheet feeding cassette 132 and the standby cassette 133, and a moving mechanism 135 that moves sheets from the sheet feeding cassette 132 to the standby cassette 133.

Figure 3:
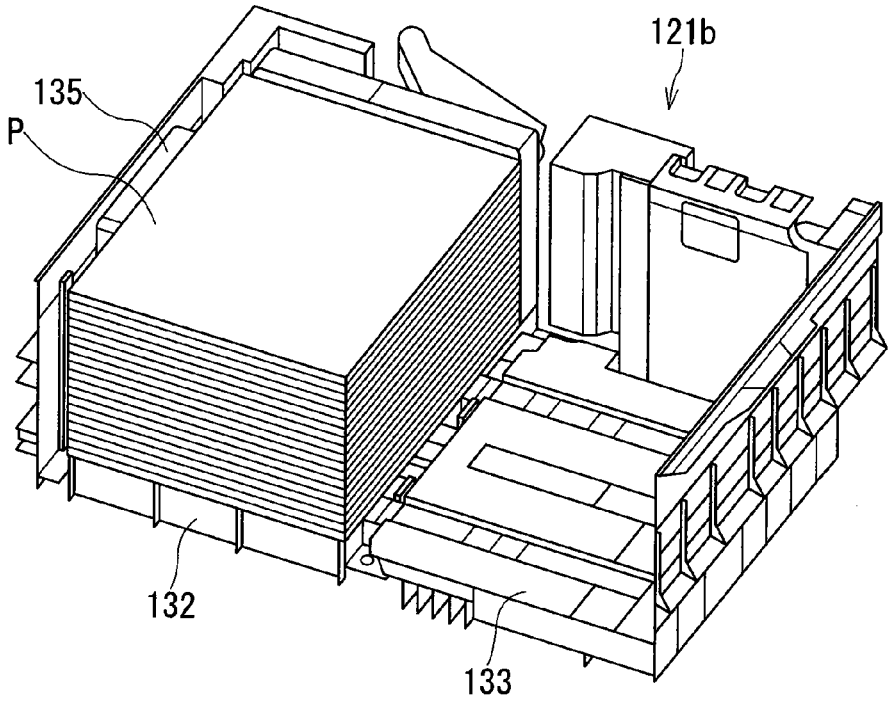
FIG. 3 is a diagram of a state of sheets stacked in a sheet feeding cassette.
Figure 4:
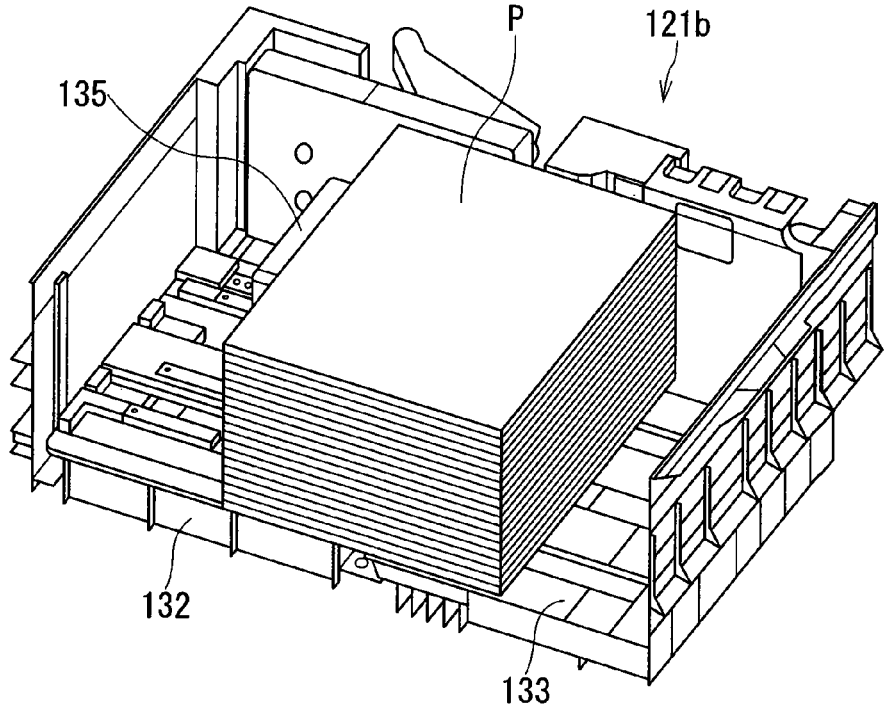
FIG. 4 is a diagram of an operation for moving the sheets P by a moving mechanism.
Figure 5:
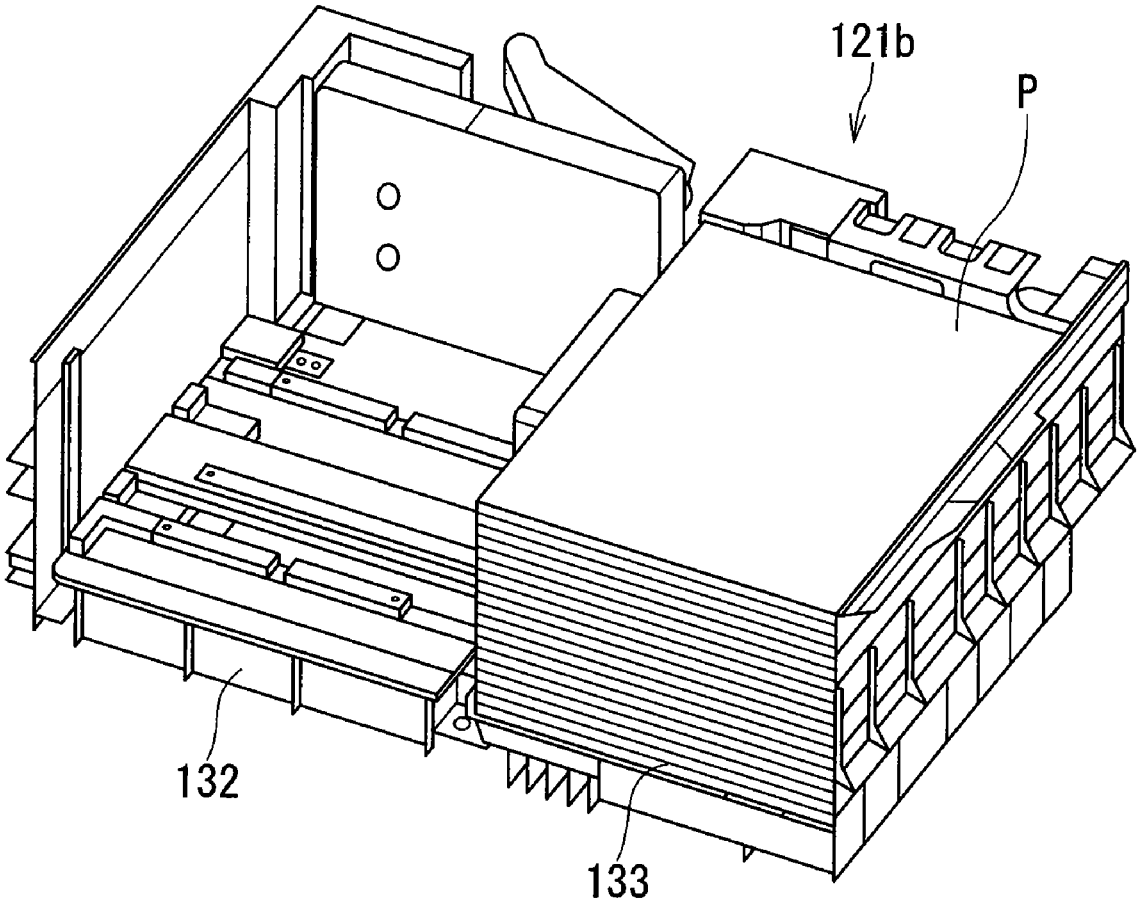
FIG. 5 is a diagram of a state of the sheets P moved to a standby cassette by the moving mechanism.

The sheet feeding cassette 132 can move between an inserted position T1 where the sheet feeding cassette 132 is inserted on the inner side of the attaching unit 131 and a drawn-out position T2 where the sheet feeding cassette 132 is drawn out to project from the inner side of the attaching unit 131. FIG. 3 is a diagram of a state of sheets stacked in the sheet feeding cassette 132. FIG. 4 is a diagram of an operation for moving the sheets P by the moving mechanism 135. If sheets stacked in the standby cassette 133 provided in the second sheet feeding unit 121*b* are exhausted, the moving mechanism 135 moves the sheets P from the sheet feeding cassette 132 adjacent to the standby cassette 133 to the standby cassette 133. As shown in FIG. 4, the moving mechanism 135 can move the sheets P stacked in the sheet feeding cassette 132 to the standby cassette 133 using a driving motor. FIG. 5 is a diagram of a state of the sheets P moved to the standby cassette 133 by the moving mechanism 135.

Figure 6B:
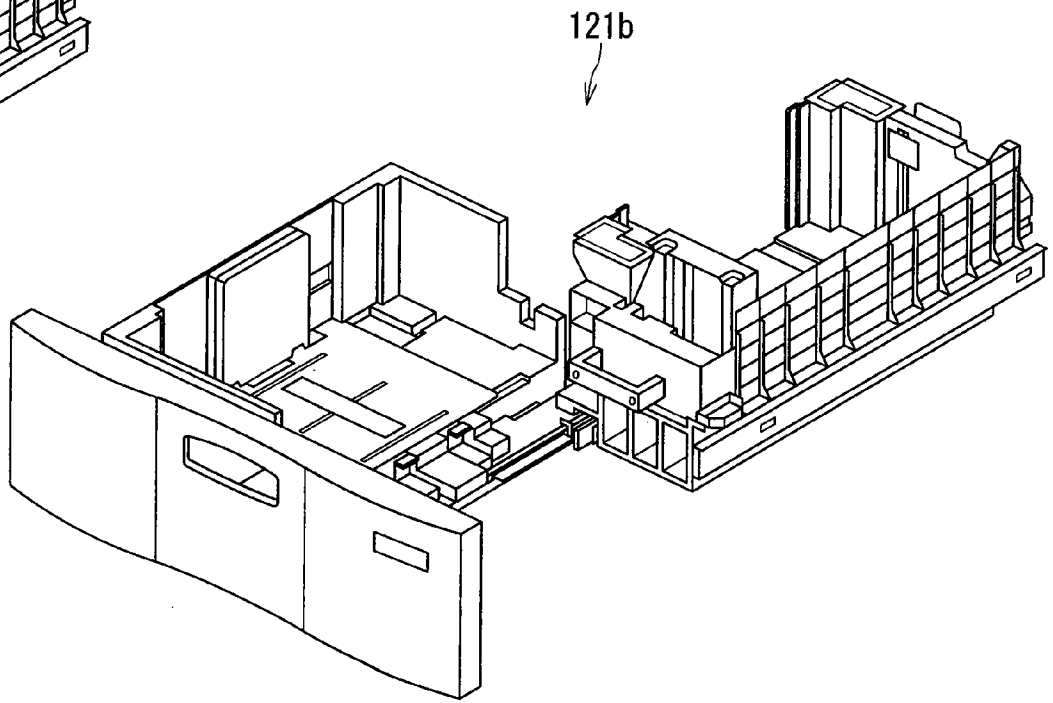
FIGS. 6A and 6B are perspective views of a second sheet feeding unit.
Figure 6A:
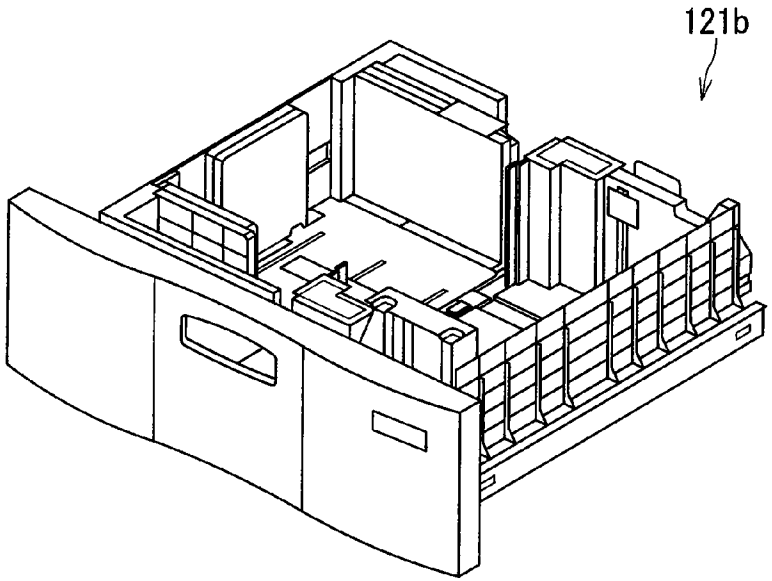

FIGS. 6A and 6B are perspective views of the second sheet feeding unit 121*b*. As shown in FIG. 6B, in the second sheet feeding unit 121*b*, it is possible to draw out the sheet feeding cassette 132 configuring the second sheet feeding unit 121*b* while maintaining a state of the standby cassette 133 configuring the second sheet feeding unit 121*b*.

Figure 7:
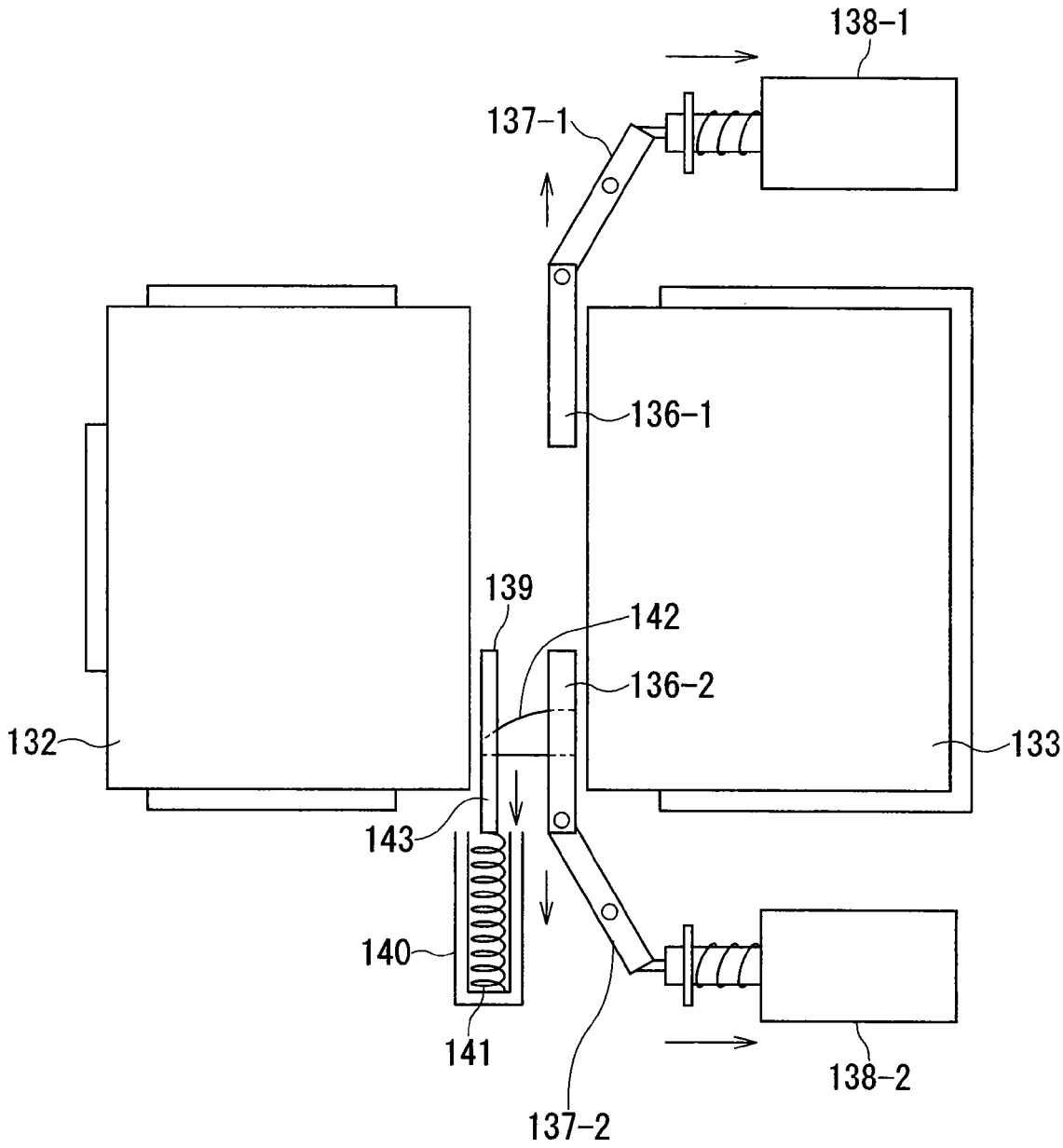
FIG. 7 is a plan view of the second sheet feeding unit viewed from above.

FIG. 7 is a plan view of the second sheet feeding unit 121*b* viewed from above. As shown in FIG. 7, a rear shutter 136-1 and a front shutter 136-2 for designating a stacking range of sheets stacked in the standby cassette 133 are provided in the standby cassette 133. The rear shutter 136-1 and the front shutter 136-2 are respectively opened and closed by solenoids 138-1 and 138-2 via driving arms 137-1 and 137-2. On the other hand, a shutter 139 for designating a stacking range of sheets stacked in the sheet feeding cassette 132 is provided in the sheet feeding cassette 132. The shutter 139 is also used for reducing sheet disarrangement that occurs if the sheets P are stacked in the sheet feeding cassette 132.

In the past, the shutter 139 is opened and closed by a solenoid provided separately from the solenoids 138-1 and 138-2. Therefore, in the past, the number of electronic components such as the solenoid used for the opening and closing of the shutter 139 increases. Therefore, in this embodiment, in the second sheet feeding unit 121*b*, the opening and closing of the shutter 139 is performed by associating the shutter 139 with the opening and closing of the rear shutter 136-1 and the front shutter 136-2 provided in the standby cassette 133 without using a solenoid for the opening and closing of the shutter 139. The shutter 139 is opened in association with the opening of the rear shutter 136-1 and the front shutter 136-2. On the other hand, the shutter 139 is closed in association with the closing of the rear shutter 136-1 and the front shutter 136-2. A shutter housing unit 140 that houses the shutter 139 during the opening and closing of the shutter 139 is provided in the sheet feeding cassette 132. A spring 141 having elasticity is provided in the inside of the shutter housing unit 140. If the shutter 139 is housed in the shutter housing unit 140 during the opening of the shutter 139, the spring 141 contracts according to a housing portion where the shutter 139 is housed. Thereafter, the spring 141 stretches, during the closing of the shutter 139, to a position before the contraction and the shutter 139 returns to an original position before it is housed. The spring 141 only has to be an elastic body having elasticity.

Figure 8:
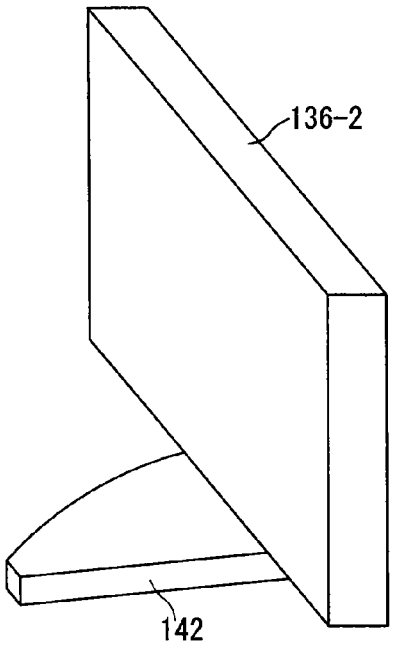
FIG. 8 is a perspective view of a front shutter provided in the standby cassette.
Figure 9:
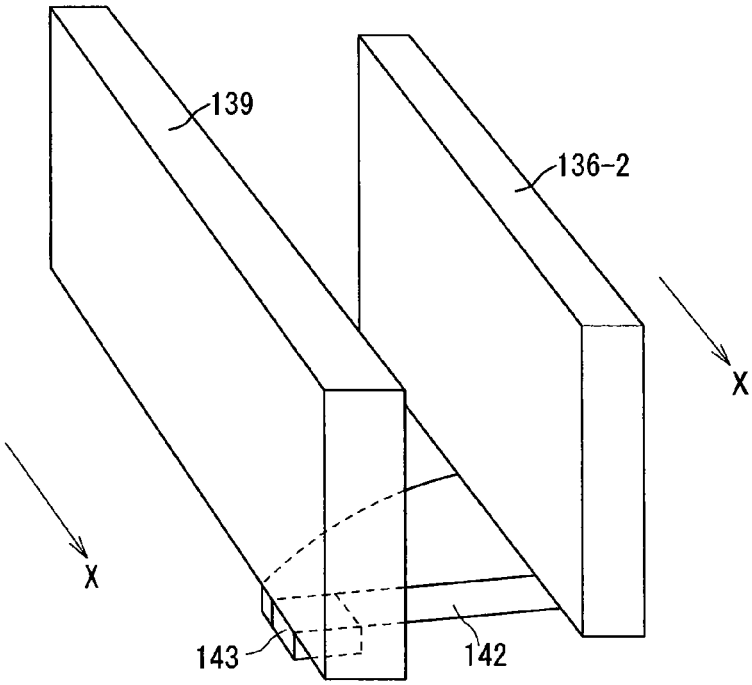
FIG. 9 is a diagram of a state of shutters opened by an opening and closing arm.

FIG. 8 is a perspective view of the front shutter 136-2 provided in the standby cassette 133. As shown in FIG. 8, an opening and closing arm 142 that opens and closes the shutter 139 in association with the opening and closing of the front shutter 136-2 is provided in a lower part of the front shutter 136-2. FIG. 9 is a diagram of a state of the shutter 139 that is opened by the opening and closing arm 142 provided in the front shutter 136-2 during the opening of the front shutter 136-2. As shown in FIG. 9, a projection 143 is provided in a lower part of the shutter 139. The opening and closing arm 142 moves in an arrow X direction following the opening of the front shutter 136-2. Thereafter, the opening and closing arm 142 comes into contact with and is caught (hooked) by the projection 143 provided in the shutter 139. If the opening and closing arm 142 is caught by the projection 143, the shutter 139 also starts to move in the arrow X direction following the opening of the front shutter 136-2. This makes it possible to open and close the shutter 139 provided in the sheet feeding cassette 132 only with the solenoids 138-1 and 138-2 provided in the standby cassette 133 without particularly providing a solenoid for driving the shutter 139 in the sheet feeding cassette 132. Therefore, it is possible to reduce the number of electronic components such as the solenoids used for opening and closing the shutters provided in the second sheet feeding unit 121*b*. As a result, if plural shutters for designating a stacking range of the sheets P are provided, it is possible to suitably associate an operation of any one of the shutters with operations of the other shutters.

Figure 10:
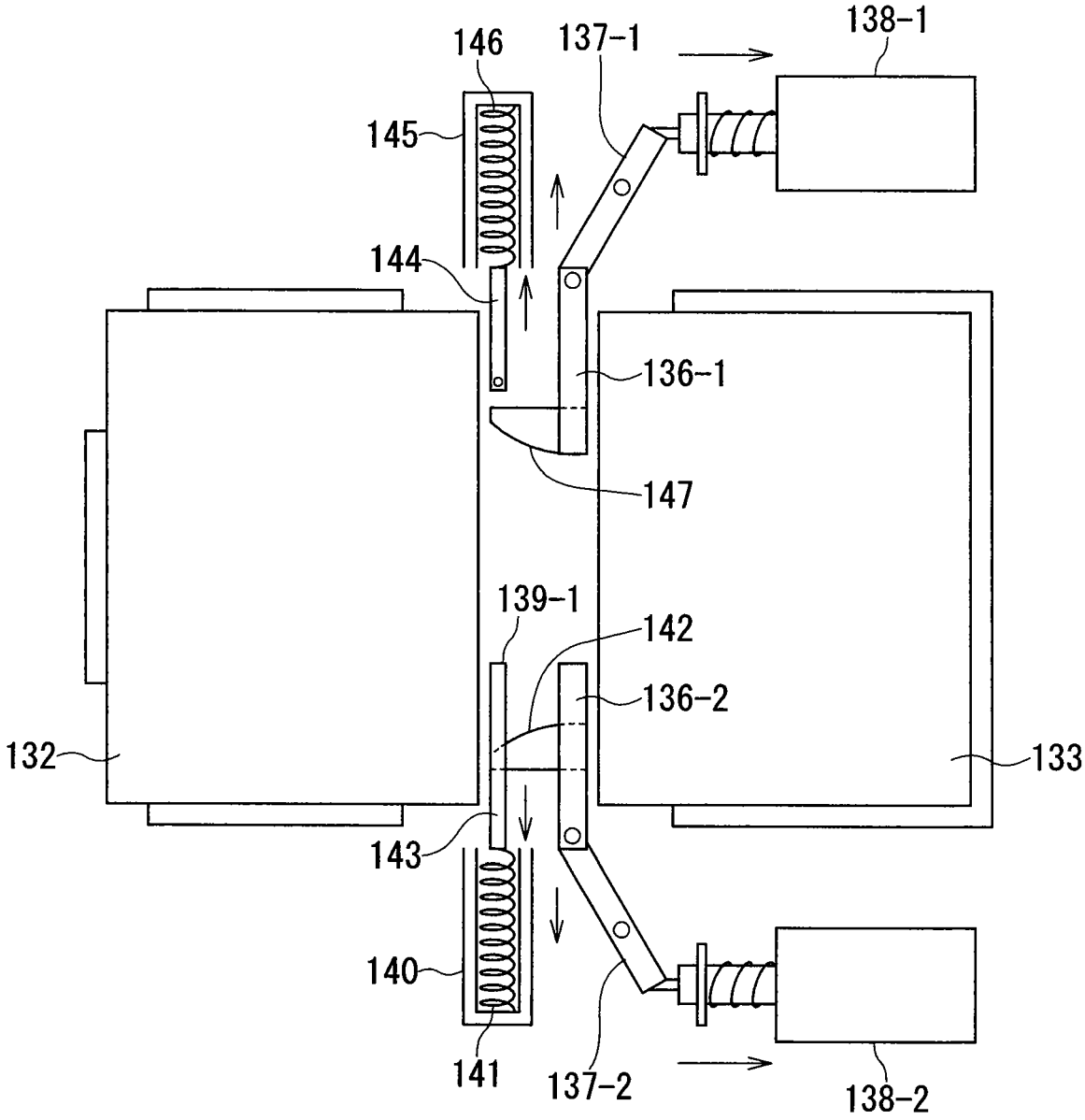
FIG. 10 is another plan view of the second sheet feeding unit viewed from above.

A shutter may be provided in a rear part of the sheet feeding cassette 132. FIG. 10 is another plan view of the second sheet feeding unit 121*b* viewed from above. As shown in FIG. 10, a shutter 144 is provided in a rear part of the sheet feeding cassette 132. A shutter hosing unit 145 that houses the shutter 144 during the opening and closing of the shutter 144 is provided in the sheet feeding cassette 132. A spring 146 having elasticity is provided in the inside of the shutter housing unit 145.

As shown in FIG. 10, an opening and closing arm 147 that opens and closes the shutter 144 in association with the opening and closing of the rear shutter 136-1 is provided in a lower part of the rear shutter 136-1. It is possible to draw out the sheet feeding cassette 132 while maintaining a state of the standby cassette 133. Therefore, the opening and closing arm 147 provided in the rear shutter 136-1 is provided in a position where the opening and closing arm 147 does not prevent the sheet feeding cassette 132 from being drawn out and inserted.

Figure 11:
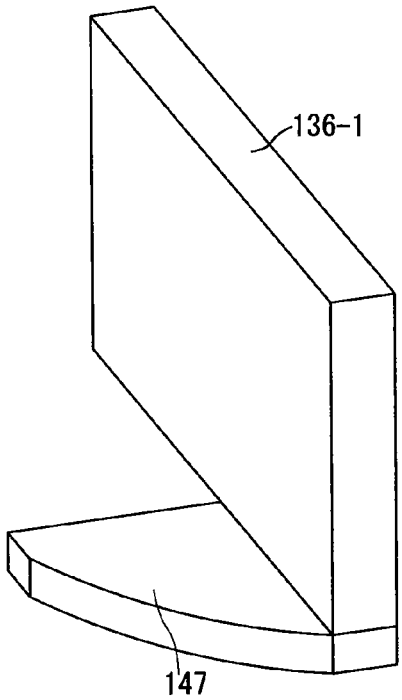
FIG. 11 is a perspective view of a rear shutter provided in the standby cassette.

FIG. 11 is a perspective view of the rear shutter 136-1 provided in the standby cassette 133. As shown in FIG. 11, an opening and closing arm 147 that opens and closes the shutter 144 in association with the opening and closing of the rear shutter 136-1 is provided in a lower part of the rear shutter 136-1.

Figure 12:
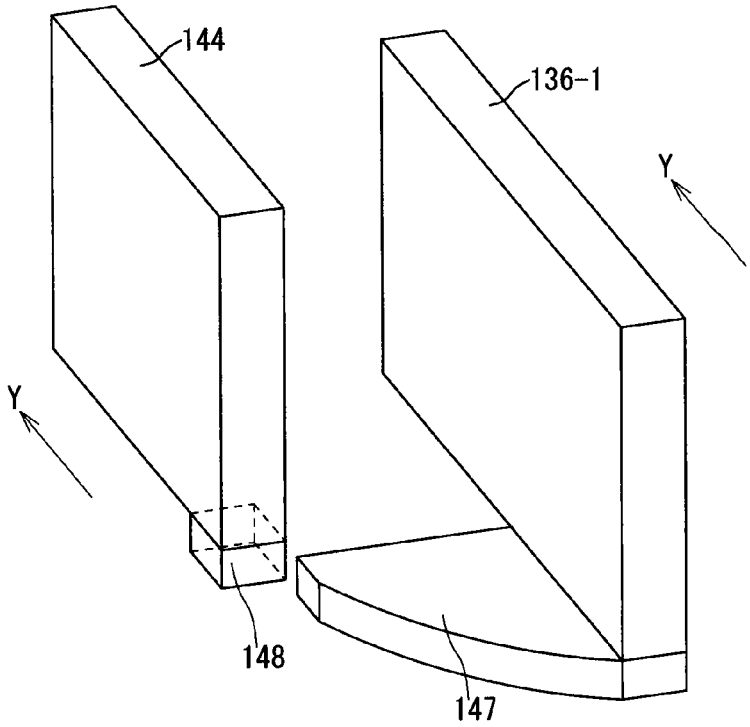
FIG. 12 is a diagram of a state of shutters opened by an opening and closing arm.

FIG. 12 is a diagram of a state of the shutter 144 that is opened by the opening and closing arm 147 provided in the rear shutter 136-1 during the opening of the rear shutter 136-1. As shown in FIG. 12, a projection 148 is provided in a lower part of the shutter 144. The opening and closing arm 147 moves in an arrow Y direction following the opening of the rear shutter 136-1. Thereafter, the opening and closing arm 147 comes into contact with and is caught by the projection 148 provided in the shutter 144. When the opening and closing arm 147 is caught by the projection 148, the shutter 144 also starts to move in the arrow Y direction following the opening of the rear shutter 136-1. This makes it possible to open and close the shutter 144 provided in the sheet feeding cassette 132 only with the solenoids 138-1 and 138-2 provided in the standby cassette 133 without particularly providing a solenoid for driving the shutter 144 in the sheet feeding cassette 132. Therefore, it is possible to reduce the number of electronic components such as the solenoids used for opening and closing the shutters provided in the second sheet feeding unit 121*b*.

Since the opening and closing arm 147 provided in the rear shutter 136-1 moves via the driving arm 137-1 according to the driving of the solenoid 138-1, a certain stroke is necessary for the movement of the opening and closing arm 147. Therefore, an operation range of the shutter 144 provided in the sheet feeding cassette 132 is set smaller than an operation range of the rear shutter 136-1 provided in the standby cassette 133.

In this embodiment, the sheet feeder includes a first sheet feeding unit (the standby cassette 133), a second sheet feeding unit (the sheet feeding cassette 132) provided adjacent to the first sheet feeding unit, one or plural first shutter(s) (the rear shutter 136-1 and the front shutter 136-2) provided in the first sheet feeding unit, driving units (the solenoids 138-1 to 138-2) that drive the first shutter(s), and one or plural second shutter(s) (the shutter 139) provided in the second sheet feeding unit. The second shutter(s) opens and closes in association with the opening and closing of the first shutter(s) driven by the driving units. Consequently, if plural shutters for designating a stacking range of the sheets P are provided, it is possible to suitably associate an operation of any one of the shutters with operations of the other shutters.

What is claimed is:

1. A sheet feeder comprising:

a first sheet feeding unit;

a second sheet feeding unit provided adjacent to the first sheet feeding unit;

a first shutter provided in the first sheet feeding unit, the first shutter having an arm;

a driving unit configured to open and close the first shutter; and a second shutter provided in the second sheet feeding unit, the second shutter having a projection, the projection being hooked by the arm of the first shutter when the first shutter is opened, and the second shutter being opened while following an opening movement of the first shutter.

2. The sheet feeder according to claim 1, further comprising:

another first shutter provided in the first sheet feeding unit, the another first shutter having another arm, and another second shutter provided in the second sheet feeding unit, the another second shutter having another projection, wherein the another projection is hooked by the another arm of the another first shutter when the another first shutter is opened, and the another second shutter is opened while following an opening movement of the another first shutter.

3. The sheet feeder according to claim 2, wherein the second shutter and the another second shutter are provided in front and rear in a drawing-out direction of the second sheet feeding unit, respectively.

4. The sheet feeder according to claim 3, wherein an operation range of the another second shutter provided in the rear in the drawing-out direction of the second sheet feeding unit is set smaller than an operation range of the another first shutter.

5. The sheet feeder according to claim 1, further comprising a housing unit configured to house the second shutter, wherein an elastic member is provided inside of the housing unit, when during opening of the second shutter, the elastic member contracts into the housing unit where the second shutter is to be housed, and during closing of the second shutter, the elastic member stretches to return the second shutter to a position outside the housing unit.

6. The sheet feeder according to claim 5, wherein the elastic member is a spring.

7. A shutter opening and closing method for a sheet feeder including a first sheet feeding unit with a first shutter and a second sheet feeding unit and with a second shutter the method comprising:

moving the first shutter toward an open position; and engaging an arm on the first shutter with a projection on the second shutter during said moving to cause second shutter to move toward an opened position.

8. An image forming apparatus comprising:

a first sheet feeding unit;

a second sheet feeding unit provided adjacent to the first sheet feeding unit;

a first shutter provided in the first sheet feeding unit, the first shutter having an arm;

a driving unit configured to open and close the first shutter; and a second shutter provided in the second sheet feeding unit, the second shutter having a projection, the projection being hooked by the arm of the first shutter when the first shutter is opened, and the second shutter being opened while following an opening movement of the first shutter.

9. The apparatus according to claim 8, further comprising:

another first shutter provided in the first sheet feeding unit, the another first shutter having another arm, and another second shutter provided in the second sheet feeding unit, the another second shutter having another projection, wherein the another projection is hooked by the another arm of the another first shutter when the another first shutter is opened, and the another second shutter is opened while following an opening movement of the another first shutter.

10. The apparatus according to claim 9, wherein the second shutter and the another second shutter are provided in front and rear in a drawing-out direction of the second sheet feeding unit, respectively.

11. The apparatus according to claim 10, wherein an operation range of the another second shutter provided in the rear in the drawing-out direction of the second sheet feeding unit is set smaller than an operation range of the another first shutter.

12. The apparatus according to claim 8, further comprising a housing unit configured to house the second shutter, wherein an elastic member is provided inside of the housing unit, when during opening of the second shutter, the elastic member contracts into the housing unit where the second shutter is to be housed, and during closing of the second shutter, the elastic member stretches to return the second shutter to a position outside the housing unit.

13. The apparatus according to claim 12, wherein the elastic member is a spring.

* * * * *